US008261514B2

(12) United States Patent
Choi et al.

(10) Patent No.: US 8,261,514 B2
(45) Date of Patent: Sep. 11, 2012

(54) APPARATUS AND METHOD FOR LOADING DRUMS INTO DRUM CONTAINER

(75) Inventors: Jong-Rak Choi, Daejeon (KR); Sung-Hwan Chung, Daejeon (KR); Sung-Jin Kim, Busan (KR)

(73) Assignees: Korea Hydro & Nuclear Power Co., Ltd., Seoul (KR); Bukwang Industrial Co., Ltd., Busan (KR)

( * ) Notice: Subject to any disclaimer, the term of this patent is extended or adjusted under 35 U.S.C. 154(b) by 272 days.

(21) Appl. No.: 12/816,490

(22) Filed: Jun. 16, 2010

(65) Prior Publication Data

US 2011/0194922 A1 Aug. 11, 2011

(30) Foreign Application Priority Data

Feb. 5, 2010 (KR) ..... 10-2010-0011148

(51) Int. Cl.
*B65B 5/08* (2006.01)
*B65B 7/28* (2006.01)
*G21F 5/14* (2006.01)

(52) U.S. Cl. ..... 53/467; 53/475; 53/244; 53/284.5; 414/799; 588/16

(58) Field of Classification Search ..... 53/446, 53/467, 471, 475, 543, 544, 244, 281, 284.5; 414/799; 588/16; *G21F 5/14*
See application file for complete search history.

(56) References Cited

U.S. PATENT DOCUMENTS

| | | | | | |
|---|---|---|---|---|---|
| 3,284,985 | A | * | 11/1966 | Roth | 53/543 |
| 3,402,831 | A | * | 9/1968 | Coombe | 414/799 |
| 3,740,919 | A | * | 6/1973 | Heisler | 53/446 |
| 3,848,394 | A | * | 11/1974 | Heisler | 53/446 |
| 4,151,983 | A | * | 5/1979 | Stock et al. | 294/66.2 |
| 4,475,860 | A | * | 10/1984 | Okamoto et al. | 414/416.03 |
| 4,686,813 | A | * | 8/1987 | Sawada | 53/446 |
| 5,415,520 | A | * | 5/1995 | Seiver | 414/799 |
| 6,074,155 | A | * | 6/2000 | Hirschek | 414/273 |
| 7,621,713 | B2 | * | 11/2009 | Pen et al. | 414/799 |
| 2005/0046213 | A1 | * | 3/2005 | Geddo | 294/95 |
| 2009/0159550 | A1 | * | 6/2009 | Singh et al. | 588/16 |
| 2010/0270482 | A1 | * | 10/2010 | Werschnik et al. | 250/507.1 |

FOREIGN PATENT DOCUMENTS

DE 2703195 A * 8/1978

(Continued)

*Primary Examiner* — Stephen F Gerrity
(74) *Attorney, Agent, or Firm* — Leydig, Voit & Mayer, Ltd.

(57) ABSTRACT

An apparatus and method for loading drums into a drum container, in which a function of gripping a lid of the drum container is added to a gripper used when a drum filled with radioactive waste is loaded into the drum container, thereby considerably reducing loading time of the drums, risk of dropping the drum, and preventing a radiation exposure risk. The apparatus includes a drum feeder transferring a drum, a drum container into which the drums transferred through the drum feeder are sequentially loaded, a support frame on which a lid of the drum container is placed when the drums are being loaded, and a crane having a gripper that selectively grips and transfers the drum or the drum container lid. The gripper includes radial gripper arms, an arm hydraulic unit reciprocating the gripper arms, jaws on inner sides of the gripper arms and gripping an outer surface of the drum, and latches for latching the drum container lid.

7 Claims, 6 Drawing Sheets

FOREIGN PATENT DOCUMENTS

| | | | | |
|---|---|---|---|---|
| EP | 1491465 | A1 | * | 12/2004 |
| JP | 53084855 | A | * | 7/1978 |
| JP | 2001183498 | A | * | 7/2001 |
| JP | 2003156594 | A | * | 5/2003 |
| JP | 2004170280 | A | * | 6/2004 |
| JP | 2008175796 | A | * | 7/2008 |

* cited by examiner

APPARATUS AND METHOD FOR LOADING DRUMS INTO DRUM CONTAINER

FIELD OF THE INVENTION

1. Technical Field

The present invention disclosed herein relates generally to an apparatus and method for loading drums into a drum container, and more particularly to an apparatus and method for loading drums into a drum container, in which a function of gripping a lid of the drum container is added to a gripper used when the drum filled with radioactive waste is loaded into the drum container, thereby considerably reducing a loading time of the drums as well as a drop accident risk of the drum, and preventing a radiation exposure risk associated with radioactive waste treatment.

2. Related Art

In general, radioactive waste is inevitably generated from systems or facilities using atomic energy such as atomic power stations.

This radioactive waste is contained in drums manufactured specially, and the drums are transferred by a drum feeder and loaded into a drum container in a set. Afterwards, for disposal of the radioactive waste, the drum container is transported to a designated place where the radioactive waste is stored.

This radioactive waste must be carefully treated due to radiation of radioactive rays. As such, it is important to reduce risks, for instance a drop accident of the drum, and to treat the radioactive waste within as short a time as possible, and workers must take care not to be directly exposed to the radioactive waste.

In a conventional system for loading radioactive waste drums into the drum container, a separate apparatus for handling a lid of the drum container is installed in addition to a drum gripper. In this case, to transfer the drum container lid when loading the drums, the drum gripper is separated from a crane hook, and then the lid handling apparatus must be installed on the crane hook. As a result, the system has problems in that it takes much time to load the drums, and that there is a risk of the drum being dropped due to its heavy weight.

For this reason, the drum container lid is generally handled by the crane hook without using the separate lid handing apparatus.

To this end, the drum container lid is provided with a plurality of eye bolts, and the eye bolts must be connected with a plurality of wire ropes to form a joint. Even in this case, the drum gripper must be attached to or detached from the crane hook when the drum container lid is handled, so that it takes much time to load the drums.

In addition, after all the drums are loaded into the drum container, a worker must get on the drum container containing the radioactive waste drums, and directly remove the eye bolts and the wire ropes from the drum container lid. Thus, the worker is exposed to radioactive rays for a longer time, and thus faces a high risk of radiation exposure.

Further, when the drums are loaded into the drum container, the drum gripper grips an upper end of the drum. Here, if the drum suffers an external shock or has a defect, the drum may be separated from the drum gripper, dropped to the bottom of the system, and damaged by its drop shock, so that the radioactive waste may be scattered to the outside.

SUMMARY

The present invention is directed to an apparatus and method for loading drums into a drum container, capable of enhancing the safety of work when the drums filled with radioactive waste are loaded into the drum container, simplifying a process of loading the drums to reduce a working time as well as a treatment risk of a heavy object, and removing a cause of approaching a radioactive material to prevent a radiation exposure risk associated with radioactive waste treatment.

According to an aspect of the present invention, there is provided an apparatus for loading drums into a drum container, which includes: a drum feeder transferring a drum filled with radioactive waste; a drum container into which the drums transferred through the drum feeder are sequentially loaded; a support frame on which a lid of the drum container is placed when the drums are loaded; and a crane having a gripper that selectively grips and transfers the drum or the drum container lid and a lifter on which the gripper is mounted so as to move up and down and which is transferred along guide rails in forward and backward, or left and right directions. The gripper includes: a plurality of gripper arms radially installed at regular angular intervals; an arm hydraulic unit reciprocating the gripper arms in a radial direction; jaws installed on inner sides of the gripper arms and gripping an outer surface of the drum; and latches protruding from the inner sides of the gripper arms and latched on the drum container lid.

In exemplary embodiments, the gripper may further include an arm rotating mechanism rotating the gripper arms in a circumferential direction.

In exemplary embodiments, the jaws may be installed on inner surfaces of lower portions of the gripper arms, and the latches may protrude from inner surfaces of lower ends of the gripper arms below the jaws.

According to another aspect of the present invention, there is provided an apparatus for loading drums into a drum container, which includes: a drum feeder transferring a drum filled with radioactive waste; a drum container into which the drums transferred through the drum feeder are sequentially loaded; a support frame on which a lid of the drum container is placed when the drums are loaded; and a crane having a gripper which includes jaws gripping the drum and latches latched on the drum container lid so as to selectively grip and transfer the drum or the drum container lid, and a lifter on which the gripper is mounted so as to move up and down and which is transferred along guide rails in forward and backward, or left and right directions. The drum container lid includes: a lid plate placed on a body of the drum container; and a latched part protruding upward from an upper surface of the lid plate and having a flange protruding outward from an upper circumference thereof.

In exemplary embodiments, the latched part may be installed in the center of the upper surface of the lid plate of the drum container lid.

According to yet another aspect of the present invention, there is provided a method of loading drums into a drum container using a gripper having jaws gripping a drum filled with radioactive waste and latches latched on a lid of the drum container into which the drums are loaded and selectively gripping and transferring the drum or the drum container lid. The method includes: latching the latches of the gripper on a latched part formed on an upper surface of the drum container lid; transferring and placing the drum container lid coupled to the gripper to and on a support frame; gripping the drum such that the jaws of the gripper come into close contact with an outer surface of the drum; sequentially loading the drums into the drum container; latching the latches of the gripper on the latched part of the drum container lid placed on the support frame when the loading of the drums is completed; and placing the drum container lid on the drum container body.

In exemplary embodiments, the gripping of the drum may include gripping the drum such that he jaws are located under one of reinforcing rings protruding from the outer surface of the drum.

A further understanding of the nature and advantages of the present invention herein may be realized by reference to the remaining portions of the specification and the attached drawings.

BRIEF DESCRIPTION OF THE FIGURES

Non-limiting and non-exhaustive embodiments of the present invention will be described with reference to the following figures, wherein like reference numerals refer to like parts throughout the various figures unless otherwise specified. In the figures.

DETAILED DESCRIPTION OF EXEMPLARY EMBODIMENT

Figure 1A:
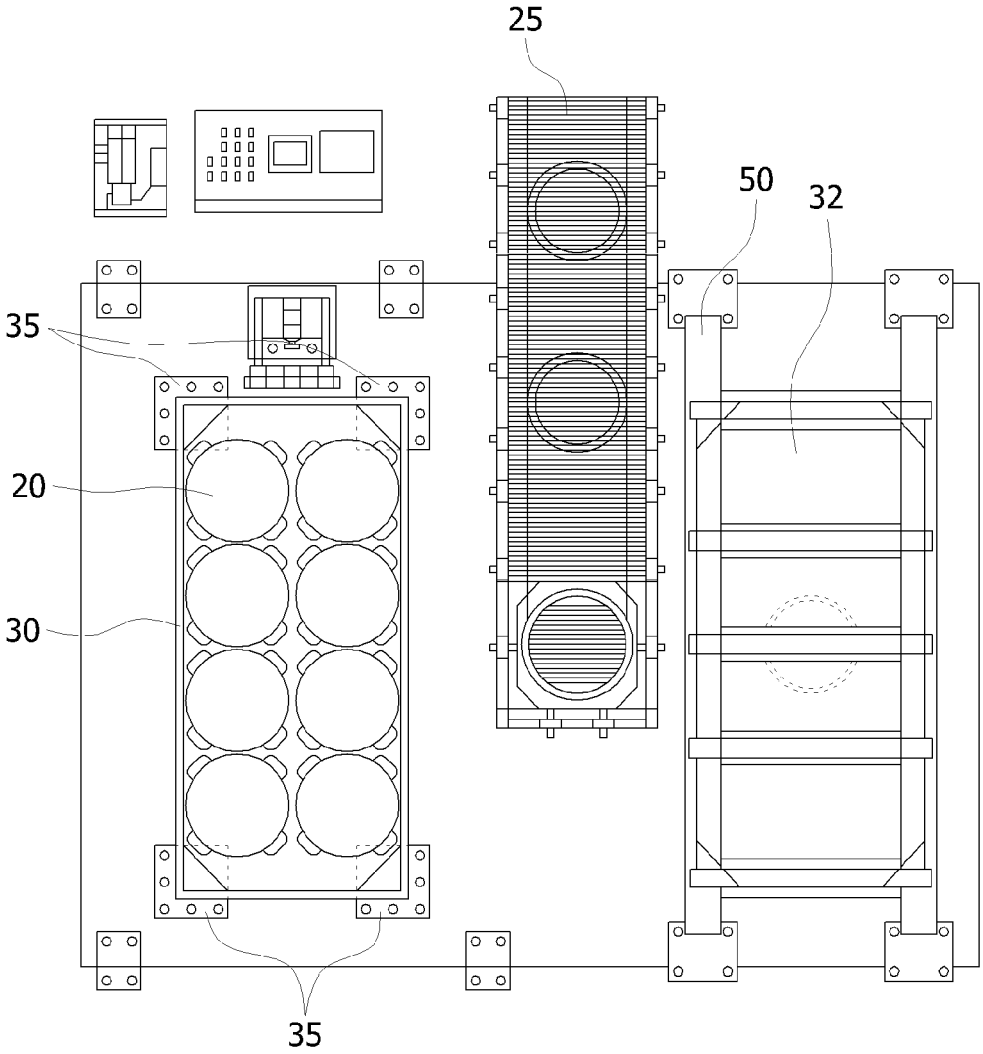
FIGS. 1A and 1B are a plan view and a front view of an apparatus for loading drums into a drum container according to an exemplary embodiment of the prevent invention.

Exemplary embodiments of the present invention will be described below in more detail with reference to the accompanying drawings. The present invention may, however, be embodied in different forms and should not be constructed as limited to the embodiments set forth herein. Rather, these embodiments are provided so that this disclosure will be thorough and complete, and will fully convey the scope of the present invention to those skilled in the art Like reference numerals refer to like elements throughout the accompanying figures.

Figure 1B:
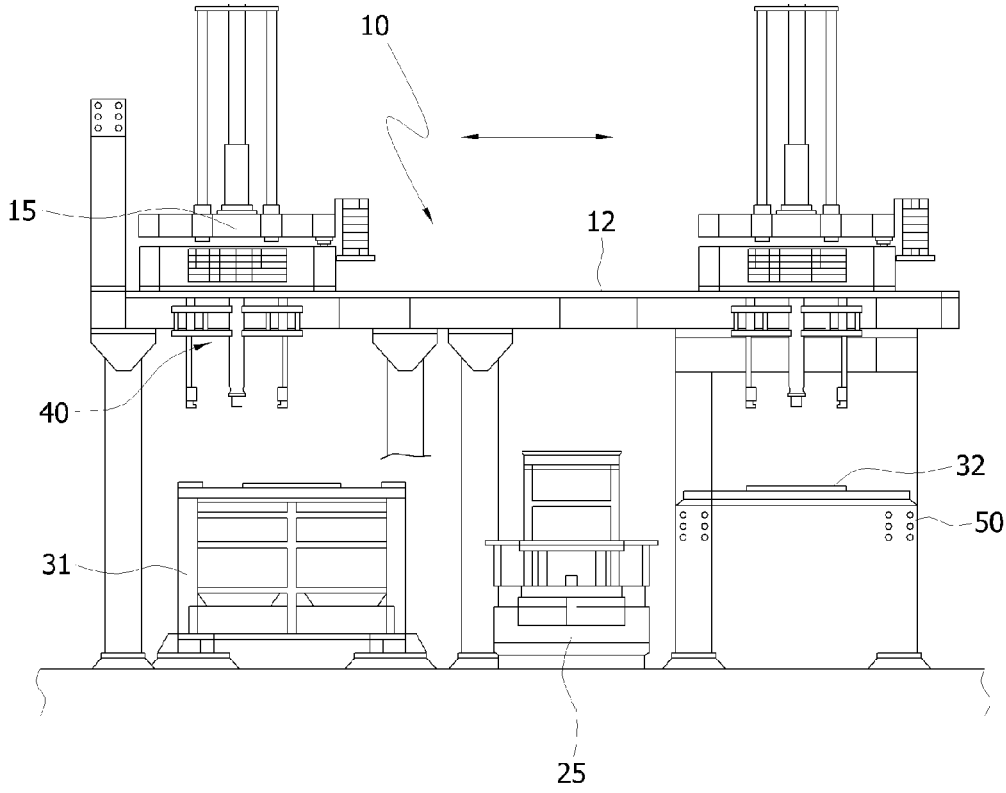

FIGS. 1A and 1B are a plan view and a front view of an apparatus for loading drums into a drum container according to an exemplary embodiment of the prevent invention.

An apparatus for loading drums and a drum container according to an exemplary embodiment of the present invention includes a drum feeder 25 transferring a drum 20 filled with radioactive waste toward a crane 10, a drum container 30 having a body 31 and a lid 32 and into which a plurality of drums 20 are loaded, a gripper 40 selectively gripping and transferring the drum 20 or the drum container lid 32, and a support frame 50 on which the drum container lid 32 is placed.

The gripper 40 is mounted on a lifter 15 so as to move up and down. Further, the gripper 40 is installed so as to be movable along guide rails 12 installed on the crane 10 in left and right, or forward and backward directions in cooperation with the lifter 15.

The drum container 30 is fixedly supported on drum container pedestals 35 installed at lower corners of the body 31.

Figure 2:
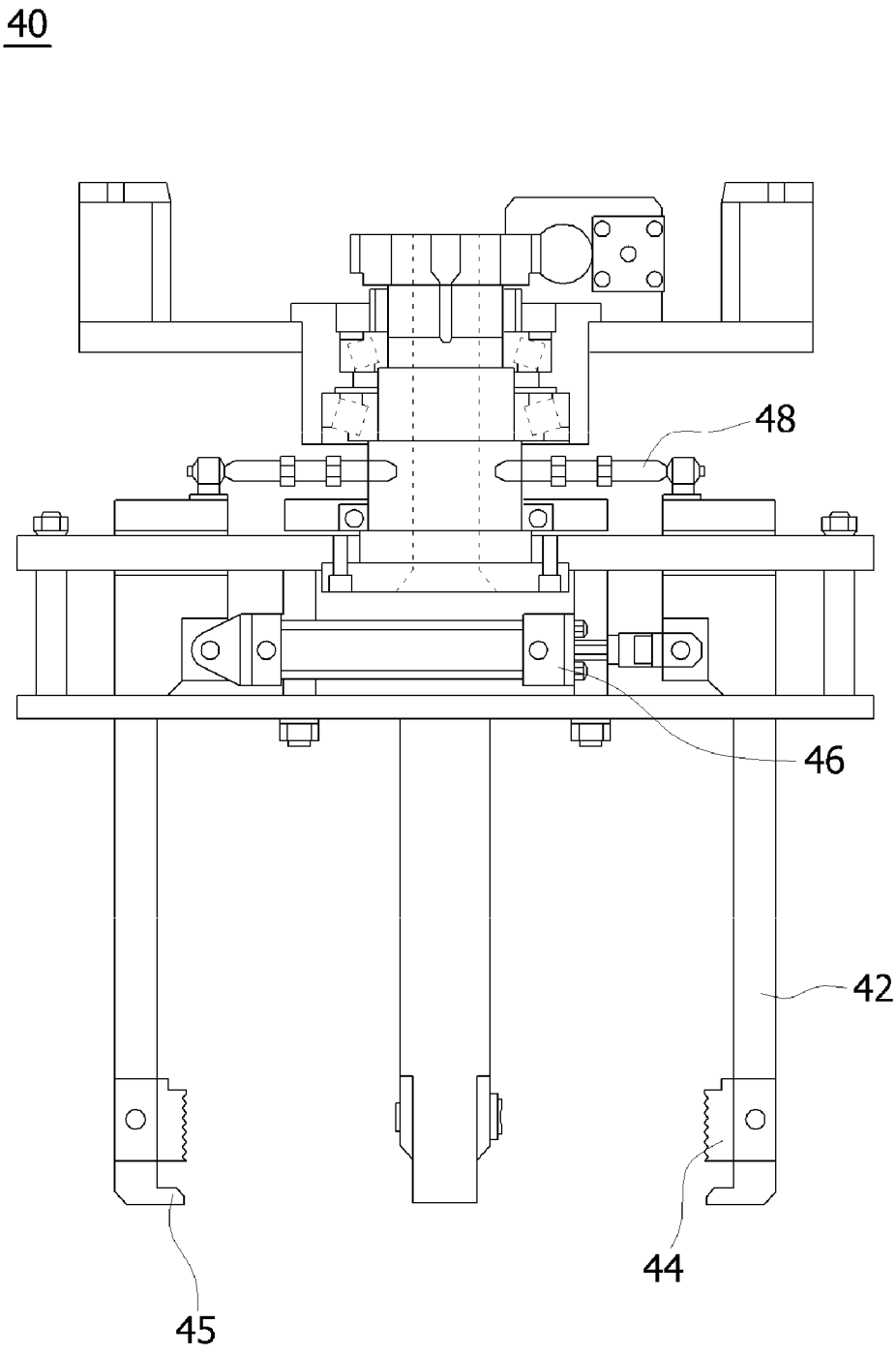
FIG. 2 illustrates the structure of a gripper for gripping a drum and a drum container lid in an apparatus for loading drums into a drum container according to an exemplary embodiment of the prevent invention.

FIG. 2 illustrates the structure of a gripper for gripping a drum and a drum container lid in an apparatus for loading drums into a drum container according to an exemplary embodiment of the present invention.

The gripper 40 is characterized by a structure in which the drum 20 and the drum container lid 32 can be transferred using the same unit when the drum 20 is loaded into the drum container 30 from the drum feeder 25.

The gripper 40 includes a plurality of gripper arms 42 radially installed at regular angular intervals, an arm hydraulic unit 46 reciprocating the gripper arms 42 in a radial direction, jaws 44 installed on inner sides of the gripper arms 42 and gripping an outer surface of the drum 20, and latches 45 protruding from the inner sides of the gripper arms 42 and latched on the drum container lid 32.

The gripper 40 is provided with an arm rotating mechanism 48 for rotating the gripper arms 42 to a position where it is easy to grip the drum 20.

As described below, the jaws 44 may be installed on inner sides of lower portions of the gripper arms 42 in consideration of the gripping position of the drum 20. The latches 45 may be installed on inner sides of lower ends of the gripper arms 42 in consideration of a latching position of the drum container lid 32.

Figure 3:
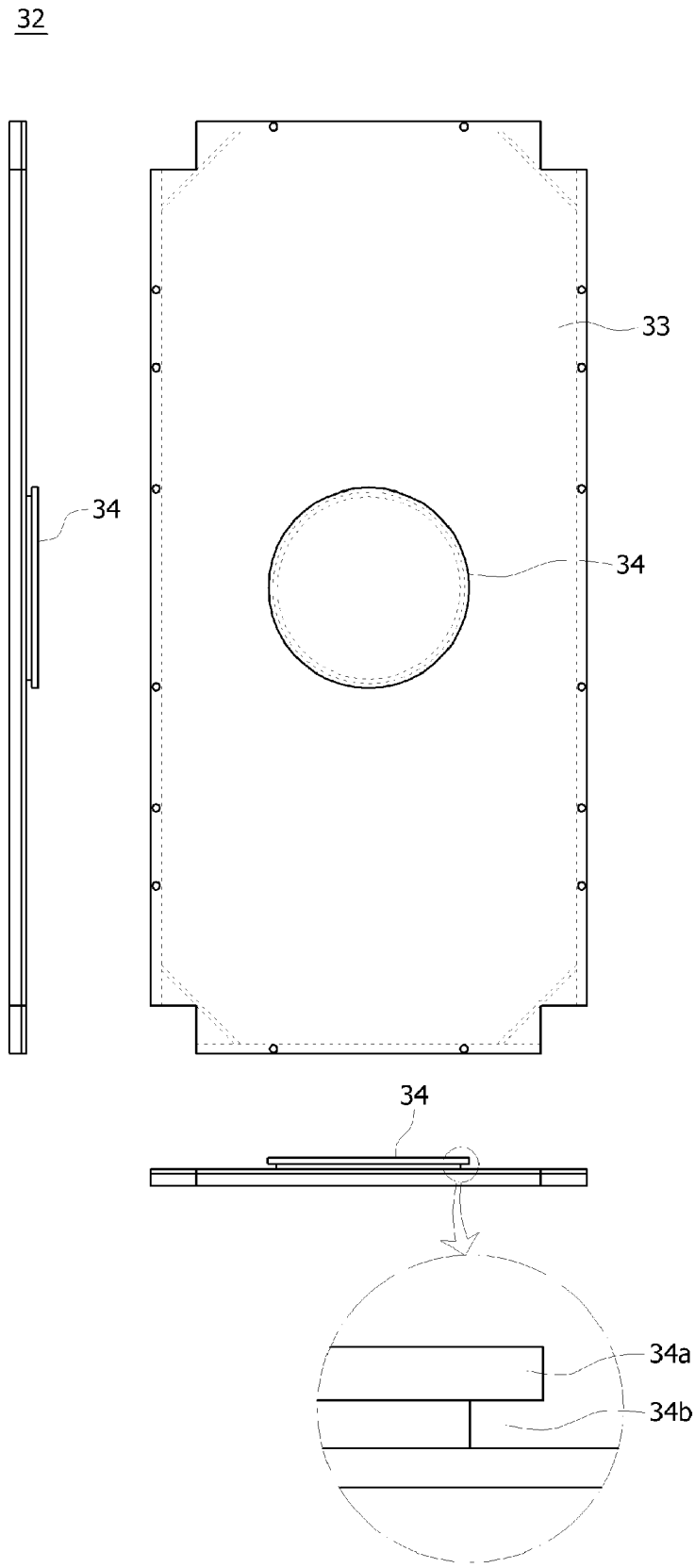
FIG. 3 illustrates the structure of a drum container lid in an apparatus for loading drums into a drum container according to an exemplary embodiment of the prevent invention.

FIG. 3 illustrates the structure of a drum container lid in an apparatus for loading drums into a drum container according to an exemplary embodiment of the prevent invention.

The drum container lid 32 includes a lid plate 33 and a latched part 34 installed in the center of an upper surface thereof.

The latched part 34 protrudes upward from the upper surface of the lid plate 33 of the drum container lid 32, and includes a flange 34*a* protruding outward from an upper circumference thereof so as to be latched by the latches 45 of the gripper 40. A latching groove 34*b* is defined between the flange 34*a* and the upper surface of the lid plate 33.

With this configuration, when the drum container lid 32 is gripped by the gripper 40, the latches 45 are latched into the latching groove 34*b*.

Figure 4:
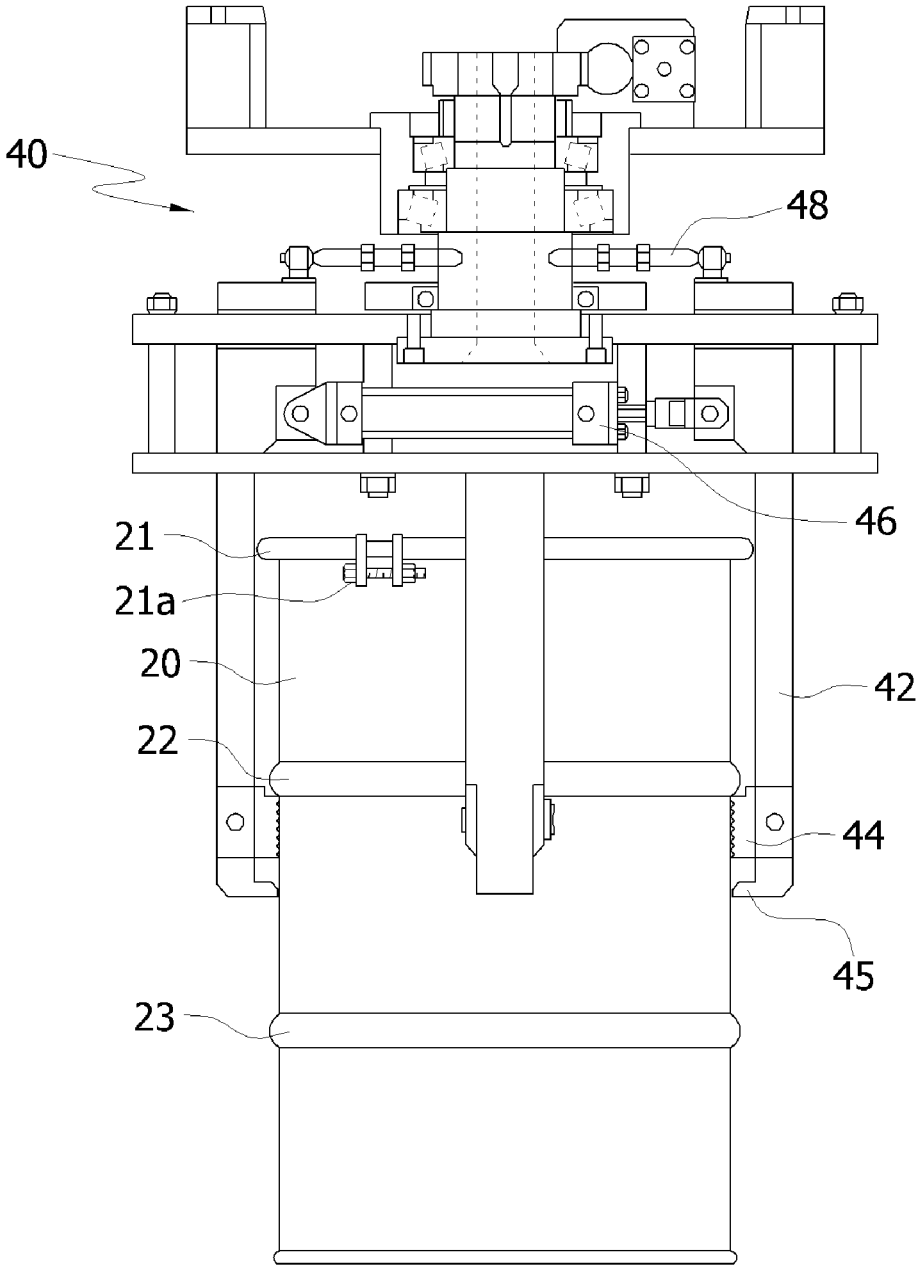
FIG. 4 illustrates the state where a drum is gripped by a gripper for gripping a drum and a drum container lid in an apparatus for loading drums into a drum container according to an exemplary embodiment of the prevent invention.
Figure 5:
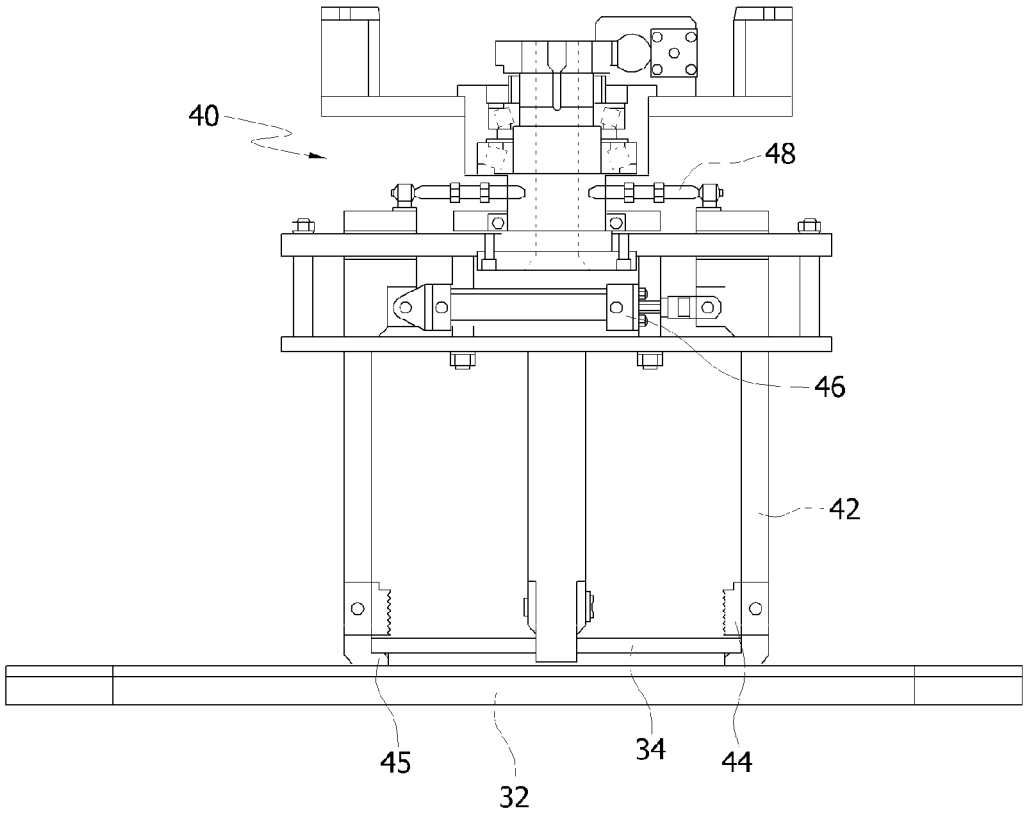
FIG. 5 illustrates the state where a drum container lid is gripped by a gripper for gripping a drum and a drum container lid in an apparatus for loading drums into a drum container according to an exemplary embodiment of the prevent invention.

FIG. 4 illustrates the state where a drum is gripped by a gripper for gripping a drum and a drum container lid in an apparatus for loading drums into a drum container according to an exemplary embodiment of the prevent invention. FIG. 5 illustrates the state where a drum container lid is gripped by a gripper for gripping a drum and a drum container lid in an apparatus for loading drums into a drum container according to an exemplary embodiment of the prevent invention.

Now, a method of loading the drums 20 into the drum container 30 using the gripper 40 will be described step by step.

In a first step, to load the drums 20, which are transferred toward the crane 10 by the drum feeder 25, into the drum container 30, the lid 32 of the drum container 30 must be separated from the body 31 of the drum container 30, and then be transferred to the support frame 50.

The drum container 30 is placed on the drum container pedestals 35, and then bolts connecting the body 31 and lid 32 of the drum container 30 are unfastened.

Then, the gripper 40 installed under the lifter 15 moves down toward the drum container lid 32 by operation of the lifter 15, and the latches 45 of the gripper 40 simultaneously move down until they reach a level corresponding to the latched groove 34*b* formed in the latched part 34 of the drum container lid 32.

Here, the gripper arms 42 of the gripper 40 are made slightly wider than an outer diameter of the latched part 34 of the drum container lid 32.

Next, the arm hydraulic unit 46 is driven to make the gripper arms 42 narrower. Thereby, the latches 45 of the lower ends of the gripper arms 42 are latched into the latching groove 34*b* of the latched part 34.

In this way, when the gripper 40 grips the drum container lid 32, the gripper 40 gripping the drum container lid 32 is lifted by the lifter 15 of the crane 10, and transfers the drum container lid 32 to the support frame 50. Then, the arm hydraulic unit 46 is driven to make the gripper arms 42 wider, and separates the gripper 40 from the drum container lid 32, so that the drum container 32 is placed on the support frame 50.

In a second step, the drums 20 are sequentially loaded at designated positions in the drum container body 31 from which the drum container lid 32 is separated.

When the drum 20 filled with radioactive waste is fed to a gripping position through the drum feeder 25, the lifter 15 lowers the gripper 40 so as to grip the drum 20.

As illustrated in FIG. 4, the drum 20 is provided with a lid fastener 21 on an outer circumference of an upper end thereof which is fastened by a drum bolt 21*a*. First and second reinforcing rings 22 and 23 protrude from the outer circumference of the drum 20 spaced apart from each other by a determined interval.

Thus, when the gripper 40 is lowered, the gripper arms 42 may be impeded by the drum bolt 21*a*. In this case, the arm rotating mechanism 48 is driven to rotate the gripper arms 42 to a position where the drum bolt 21*a* is not located, so that the gripper arms 42 can avoid the impediment of the drum bolt 21*a*.

The gripper 40 moves downward until the jaws 44 installed on the inner sides of the lower portion of the gripper arms 42 are located below the first reinforcing ring 22 of the drum 20.

Next, the arm hydraulic unit 46 is driven to make the gripper arms 42 narrower, and the inner surfaces of the jaws 44 of the gripper arms 42 come into close contact with the outer surface of the drum 20. Thereby, the drum 20 is gripped by friction against the contact surfaces of the jaws 42 and the drum 20.

Here, the jaws 44 are located so as to grip a lower surface of the first reinforcing ring 22 of the drum 20, so that even if sliding happens on a contact surface between the jaws 44 and the drum 20 when the drum 20 is transferred, upper ends of the jaws 44 are caught on the first reinforcing ring 22, and thus the drum 20 can be prevented from being dropped.

Afterwards, the lifter 15 raises the gripper 40 gripping the drum 20, is transferred in left and right, or forward and backward directions by the operation of the crane 10, and lowers the drum 20 at a designated position in the drum container 30.

When the drum 20 arrives at the designated position, the gripper arms 42 are made wider by the operation of the arm hydraulic unit 46, and then are separated from the drum 20. Thus, the gripper 40 exits the drum container 30.

This process is repeated, and thereby the drums 20 are sequentially loaded into the drum container 30.

In a third step, when all the drums 20 are loaded into the drum container 30, the drum container lid 32 is coupled to the drum container body 31 again.

To this end, the gripper 40 is transferred to the support frame 50 for the drum container lid, and is ready to grip the drum container lid 32.

Then, the gripper 40 connected to a lower end of the lifter 15 moves down to the drum container lid 32 placed on the support frame 50 by the operation of the lifter 15 until the latches 45 of the gripper 40 arrive at a level corresponding to the latching groove 34*b* formed in the latched part 34 of the drum container lid 32.

Here, the gripper arms 42 of the gripper 40 are made slightly wider than the outer diameter of the latched part 34 of the drum container lid 32.

Next, the arm hydraulic unit 46 is driven to make the gripper arms 42 narrower, so that the latches 45 of the lower ends of the gripper arms 42 are latched into the latching groove 34*b* of the latched part 34.

In this way, when the gripper 40 grips the drum container lid 32, the lifter 15 of the crane 10 raises the gripper 40 gripping the drum container lid 32, transfers the drum container lid 32 to the drum container body 31, and lowers the drum container lid 32 on the drum container body 31.

Next, the arm hydraulic unit 46 is driven to make the gripper arms 42 wider, separates the gripper 40 from the drum container lid 32, and places the drum container 32 on the drum container body 31. Then, the drum container 32 is coupled to the drum container body 31 by bolts.

Thereby, the process of loading the drums 20 into the drum container 30 is completed.

Although the foregoing description has been made to the embodiment in which the gripper 40 for gripping the drum and the drum container lid is coupled to the lifter 15, it is apparent to those skilled in the art that the gripper 40 may be coupled to an existing crane system using a wire rope, and such a modification should be interpreted as falling into the scope of the present invention.

According to the apparatus and method for loading drums into a drum container according to an exemplary embodiment of the prevent invention, the gripper capable of selectively handling the drum or the drum container lid having reinforced safety is used when the drums filled with radioactive waste are loaded into the drum container, so that it is unnecessary to replace with a separate gripper when the drum and the drum container lid are handled, and thus it is possible to reduce manpower due to reduction in work time, and a risk associated with handling a heavy object.

Further, the drum container lid having the latched part can be handled by the same gripper, so that it is unnecessary for the worker to approach the radioactive waste, and thus it is possible to reduce manpower and a radiation exposure risk.

In addition, the gripper for gripping the drum and the drum container lid can be applied to the lifter of the apparatus for loading drums into a drum container as well as an existing crane system using a wire rope.

What is claimed is:

1. An apparatus for loading drums, comprising:

a drum feeder transferring a drum;

a drum container into which drums transferred through the drum feeder are sequentially loaded;

a support frame on which a lid of the drum container is placed when the drums are being loaded into the drum container; and a crane having a gripper that selectively grips and transfers a drum or the drum container lid, and a lifter on which the gripper is mounted for upward and downward movement and which is transferred along guide rails in forward and backward, or left and right, directions, wherein the gripper includes a plurality of gripper arms radially arranged at a uniform angular interval, an arm hydraulic unit reciprocating the gripper arms in a radial direction, jaws installed on inner sides of the gripper arms and gripping an outer surface of a drum, and latches protruding from the inner sides of the gripper arms for latching the drum container lid.

2. The apparatus as set forth in claim 1, wherein the gripper further includes an arm rotating mechanism rotating the gripper arms in a circumferential direction.

3. The apparatus as set forth in claim 1, wherein the jaws are installed on inner surfaces of lower portions of the gripper arms, and the latches protrude from inner surfaces of lower ends of the gripper arms, below the jaws.

4. An apparatus for loading drums, comprising:

a drum feeder transferring a drum;

a drum container into which drums transferred through the drum feeder are sequentially loaded;

a support frame on which a lid of the drum container is placed when the drums are being loaded into the drum container; and a crane having a gripper which includes jaws for gripping a drum and latches for latching a drum container lid, for selectively gripping and transferring a drum or the drum container lid, and a lifter on which the gripper is mounted for upward and downward movement and which is transferred along guide rails in forward and backward, or left and right, directions, wherein the drum container lid includes a lid plate placed on a body of the drum container, and a latched part protruding upward from an upper surface of the lid plate and having a flange protruding outward from an upper circumference of the lid plate.

5. The apparatus as set forth in claim 4, wherein the latched part is located in the center of an upper surface of the lid plate of the drum container lid.

6. A method of loading drums into a drum container using a gripper having jaws gripping a drum and latches latching a lid of the drum container into which the drums are loaded, and selectively gripping and transferring a drum or the drum container lid, the method comprising:

latching the latches of the gripper on a latched part located on an upper surface of the drum container lid;

transferring and placing the drum container lid, coupled to the gripper, to and on a support frame;

gripping a drum such that the jaws of the gripper contact an outer surface of the drum;

sequentially loading drums into the drum container;

latching the latches of the gripper on the latched part of the drum container lid placed on the support frame when the loading of the drums has been completed; and placing the drum container lid on the drum container body.

7. The method as set forth in claim 6, wherein gripping of a drum includes gripping the drum such that the jaws are located under a reinforcing ring protruding from the outer surface of the drum.

* * * * *